United States Patent [19]

Noiles

[11] 4,056,082

[45] Nov. 1, 1977

[54] FUEL SAVING VARIABLE CLOSED POSITION FUEL AND AIR FLOW CONTROL FOR VEHICLES WITH AUTOMATIC TRANSMISSION

[76] Inventor: Douglas G. Noiles, 114 Elm Place, New Canaan, Conn. 06840

[21] Appl. No.: 542,586

[22] Filed: Jan. 20, 1975

Related U.S. Application Data

[63] Continuation-in-part of Ser. No. 423,091, Dec. 7, 1973, abandoned.

[51] Int. Cl.[2] ..... F02D 11/08

[52] U.S. Cl. ..... 123/103 R; 123/103 B

[58] Field of Search ..... 123/DIG. 11, 103 R, 123/103 B, 103 D, 198 DC, 198 DB, 179 G, 124, 119 F, 97 B; 261/65; 60/906; 180/108

[56] References Cited

U.S. PATENT DOCUMENTS

| | | | |
|---|---|---|---|
| 2,913,921 | 11/1959 | Gordon | 123/103 R |
| 3,253,772 | 5/1966 | Parker | 123/103 R |
| 3,287,007 | 11/1966 | Schoeppach | 123/103 R X |
| 3,577,962 | 5/1971 | Ojala | 123/103 R |
| 3,768,450 | 10/1973 | Harrison | 123/103 R |

*Primary Examiner*—Ronald H. Lazarus
*Assistant Examiner*—Craig R. Feinberg
*Attorney, Agent, or Firm*—Parmelee, Johnson & Bollinger

[57] ABSTRACT

Variable closed position fuel and air flow control for vehicles with automatic transmission for improving fuel consumption efficiency of a vehicular internal combustion engine, without disabling or circumventing any engine function, accessory, or emission control device, by causing the engine to idle at substantially constant speed regardless of changes in the engine load caused by accessories such as automatic transmission, air conditioning, power steering and the like. This variable closed position fuel and air flow control device is adapted to be easily retrofitted to existing engines and includes a vacuum actuator connected to be responsive to changes in pressure in the fuel and air flow induction passage for the engine. A cam is operatively associated with the primary idle stop of the antidieseling solenoid and the throttle control arm and a linkage transmits the motion of the actuator to the cam. The inventive control apparatus provides fuel conservation in automobiles with automatic transmission and powered accessories under conditions of standstill idle and when the vehicle is driving the engine and the throttle control arm rests against its stop at the closed position. Fuel savings are effected significantly in stop and go driving such as encountered by taxicabs in congested city traffic, and fuel savings are also obtained during highway driving in hilly terrain.

23 Claims, 9 Drawing Figures

FUEL SAVING VARIABLE CLOSED POSITION FUEL AND AIR FLOW CONTROL FOR VEHICLES WITH AUTOMATIC TRANSMISSION

RELATED PATENT APPLICATIONS

The present application is a continuation-in-part of my earlier copending application Ser. No. 423,091 filed on Dec. 7, 1973 which is now abandoned.

BACKGROUND OF THE INVENTION

1. Field of the Invention

Automobiles manufactured within the last several years have incorporated successive improvements to provide greater operational safety for their occupants and to significantly reduce the production of atmospheric-polluting compounds in engine exhaust gas emissions. There have also been improvements in handling, overall performance, and comfort afforded occupants of recent model automobiles.

However, these positive improvements have generally been accompanied by a degradation of the fuel consumption efficiency in these late model automobiles. Furthermore, this increase in fuel consumption is at least in part related to the positive improvements noted above. In particular, increased fuel consumption may be related to three general causes. First, equipment designed to augment vehicular safety and ease of operation such as power brakes and power steering require the use of engine power which is necessarily subtracted from the power available to propel the automobile. Second, equipment designed to augment vehicular comfort and convenience such as automatic transmission, air conditioning, and, to a lesser extent, power operated windows and other accessories, similarly require engine power necessarily subtracted from propulsive power. Third, engineering and design modifications introduced to reduce engine exhaust pollutant emissions reduce fuel consumption efficiency for the following reasons. The engine compression ratio has been reduced, changes have been made in valve and ignition timing and, in some cases, an auxiliary air injection pump for supplementing complete combustion of exhaust gases is used, and this pump imposes loading upon the engine.

On a typical vehicle having contemporary emission control equipment, automatic transmission, air conditioning and other power accessories, a widely utilized carburetor control system employs two separate and distinct idle speed fixed throttle settings for the engine. The primary or curb operating engine idle speed with automatic transmission engaged is approximately 630 rpm. With the automatic transmission in neutral, the engine idle speed will increase to approximately 860 rpm. This 860 rpm speed is significantly greater than the "no load" minimum of about 500 to 550 rpm required by the same engine (when properly tuned) to run smoothly if used in an automobile having manual transmission and no power accessories.

The fully equipped automobile must conventionally idle at the higher rate of 630 rpm with automatic transmission engaged for the following reasons: At this idle speed, the engine produces enough power to overcome the inherent load of the automatic transmission when the vehicle is stationary with such transmission engaged; plus, enough power to drive any or all other power accessories which may be turned on. At standstill, the incremental increase in load caused by the actuation of each accessory causes an incremental decrease in engine speed so that the idle speed with all possible accessories operating may be reduced to approximately 550 rpm.

The secondary or shut down fixed throttle setting equivalent to approximately 400 to 500 rpm is used to stop the engine. The lean fuel-air mixture and high engine temperatures brought about by emission control equipment frequently cause the engine to run by autoignition or "dieseling" after the ignition is switched off. This undesirable tendency to "diesel" after being switched off is also made worse by the more open idle throttle setting required to provide enough power to drive the automatic transmission and other power accessories. The more open throttle admits a more dense fuel-air charge to the cylinders and hence higher compression and cylinder temperatures are developed during idling. In some recently manufactured automobiles, idle speeds have been increased to reduce the pollutants in exhaust emissions. This practice further aggravates the problem of "dieseling". It is also wasteful of fuel. However, when the throttle control arm is at this secondary setting, the engine will reliably stop.

The secondary idle speed is controlled on typical contemporary engines by a mechanical stop screw adjustment. The primary idle speed is controlled by a solenoid operated idle stop. This solenoid idle stop is activated when the ignition is switched on.

In summary, added power accessories require that automotive engines idle at no load at a relatively high idle speed which decreases with all accessories operating to a minimum reliable idle speed of approximately 550 rpm. This requirement of idling significantly faster in the no-load condition results in increased fuel consumption.

During deceleration of the vehicle or when driving downhill and the throttle control arm rests at its stop in the closed position, while the transmission is engaged so that vehicle momentum is effectively driving the engine through the transmission to produce engine speeds greater than that value of the substantially constant controlled idle speed, the apparatus of this invention causes the throttle to close as far as its most closed secondary setting regardless of how many power operated accessories are being operated, thereby conserving fuel and producing more effective engine braking action.

The present invention is intended to reduce fuel consumption resulting from the prior art fixed idle speed throttle opening by providing a simple apparatus easily retrofittable to existing engines and also adapted for original installation on new engines. This improved fuel consumption is achieved by causing the engine to idle at a substantially constant minimum speed consistent with smooth engine operation regardless of the amount of non-propulsive accessory load which the engine must drive and by controlling throttle opening when the throttle control arm rests on its stop in the closed position during operation when the vehicle is driving the engine. The invention permits the engine at each instant of time to operate at varying amounts of power, delivering less at idle (than in the prior art) when the engine is driving and absorbing more (than in the prior art) when the engine is being driven with the driver's foot removed from the accelerator pedal under the conditions of stop and go city driving and during highway driving in hilly terrain.

During steady state open throttle driving, such as on a level highway, the apparatus embodying this invention has no effect upon engine operation nor fuel consumption.

2. Description of The Prior Art

Devices are presently known for minimizing variation in idle speed of vehicular internal combustion engines. Such a device is disclosed in U.S. Pat. No. 3,577,962 — Ojala (assigned to Ford Motor Company) employing a centrifugal or magnetic unit to control the application of intake manifold pressure (suction) to a vacuum actuator which in turn drives a V-shaped cam. This system acts to open the throttle blade slightly during engine deceleration to improve exhaust emissions.

Other devices which control throttle position include U.S. Pat. Nos. 3,287,007 — Schoeppach; 3,682,148 — Harrison et al.; 3,730,153 — Harrison et al.; 3,254,638 — Walker et al.; 2,929,266 — Baker et al.; 2,782,025 — Olson; and 2,913,921 — Gordon.

The devices described in the patents set forth above have certain deficiencies. Some are relatively complex and hence expensive to manufacture and maintain. Typically, they may not be easily fitted to existing engines and consequently should be installed as original equipment at the time of engine manufacture. The device shown in the Ojala patent opens the throttle blade slightly during engine deceleration, when the V-shaped cam moves beyond the normal idle position, which is opposite to the manner of operation of the apparatus described herein. None of the above is shown to function in mechanical conjunction with the antidieseling solenoid, which is in current wide use to provide reliable stopping of the engine.

SUMMARY OF THE INVENTION

In a preferred embodiment, to be described in detail below, the apparatus of the present invention improves fuel consumption efficiency of a vehicular internal combustion engine without disabling or circumventing any engine function, accessory, or emission control device. The apparatus of this invention may be easily retrofitted to existing engines without the use of special tools or skills and without extensively disassembling engine components and associated accessories.

The apparatus of the present invention is intended for use in vehicular internal combustion engines of the type having an intake manifold for conducting fuel and air to the cylinders of the engine. A carburetor hving an induction passage associated with the intake manifold and fuel and air flow control means, such as a throttle valve, is utilized variably and selectively to control the feed of fuel-air mixture to the engine. The fuel and air flow control means is equipped with a control arm which is in turn connected to the accelerator pedal or other driver control. This control arm is positioned when a warmed up engine is running at curb idle by an antidieseling solenoid primary idle stop, this solenoid being energized at the instant when the engine ignition is switched on. When the engine is switched off, this solenoid idle stop retracts and allows the throttle control arm to rest against a fixed secondary stop further closing the throttle valve to prevent dieseling, thereby reliably stopping the engine.

The illustrative embodiment of the present invention includes a U-shaped support bracket having two legs which are adapted to be mounted to the antidieseling solenoid. In one embodiment as shown, one leg of this support bracket is provided with a T-shaped tab which engages a corresponding notch in the solenoid casing. The other bracket leg is provided with a hole that accommodates and is sprung over the opposite end of the solenoid casing. In a second embodiment as shown, both legs of this bracket are provided with clamps which embrace opposite ends of the solenoid casing.

A vacuum actuator is mounted on the supporting bracket and has an output shaft. This actuator is connected to the induction passage to be responsive to the vacuum pressure in the induction passage. The vacuum actuator may be coupled to the induction passage downstream of the throttle valve to accomplish this sensing and responding function.

In the embodiments as shown, a cam having an inclined surface is interposed between the throttle operating arm and the antidieseling solenoid primary idle stop. A lever system, mounted in the supporting bracket, multiplies the motion of the vacuum actuator and couples the actuator to this cam.

When the load being placed on the engine by power accessories is increased during idle, the engine speed tends to decrease, thereby tending to decrease the vacuum (which is the same as increasing the absolute pressure) in the induction passage. In response, the vacuum motor moves the cam so as to move the throttle operating arm further from the primary solenoid idle stop, further opening the throttle to offset the tendency for the engine speed to decrease. Conversely, when load is removed from the engine, engine speed tends to increase, tending to increase the vacuum (or decreasing the absolute pressure) in the manifold. In response, the vacuum actuator moves the cam to permit the throttle operating arm to move more closely to the primary solenoid idle stop, closing the throttle to offset the tendency for the engine speed to increase. In this manner, the apparatus of the present invention controls engine idle speed to hold it at a substantially constant value regardless of the amount of load being placed on the engine at any given instant during idling.

The vacuum actuator (or motor) linkage and cam system can be adapted to respond to a range of pressure changes in the induction passage greater than the changes in pressure associated with engine operation from "full load" idle to "no load" idle in a manner whereby reduced pressure in the induction passage created by closed throttle deceleration of the engine in the driving mode or downhill operation at speeds higher than those in the idling range will cause the throttle valve to become more closed than it would be under any operating idling condition. At substantially reduced manifold pressures associated with closed throttle deceleration from vehicle speed above approximately 25 miles per hour or downhill operation, the throttle is allowed to close to its most closed secondary fixed position. This reduces fuel consumption and is accompanied by the transfer of the energy of vehicle motion through the transmission to the engine, i. e. the engine is absorbing more power from the motion of the vehicle than in the prior art. Such absorbed power is used to drive any power accessories which may be in operation at the time.

Under the arrangement described in the paragraph above, when deceleration continues to the condition of vehicle speed matching the "no load" idle speed of the engine, that is, when the engine is no longer being driven by the momentum of the vehicle, the induction passage pressure will increase causing the vacuum motor, linkage and cam system to open the throttle to the no load idle position. This throttle opening transition occurs smoothly in conjunction with the change in pressure in the induction passage. The driver is unaware that the throttle opening is changing during deceleration, but he will probably sense the increased engine braking provided by the apparatus embodying this invention. Deceleration to a full stop will cause the throttle to open to the controlled position corresponding to the actual load on the engine at the standstill condition.

Accordingly, it is an object of the present invention to provide unique and novel apparatus which improves fuel consumption efficiency of a vehicular internal combustion engine without disturbing, in any way, any engine function, accessory, or emission control equipment. This apparatus may be easily installed on existing engines without need for specialized tools or skills and may be conveniently installed as original equipment on new engines.

Other objects, aspects, and advantages of the present invention will be pointed out in, or will be understood from the following detailed description when considered in conjunction with the accompanying drawings.

DESCRIPTION OF THE PREFERRED EMBDDIMENTS

Figures 1, 8:
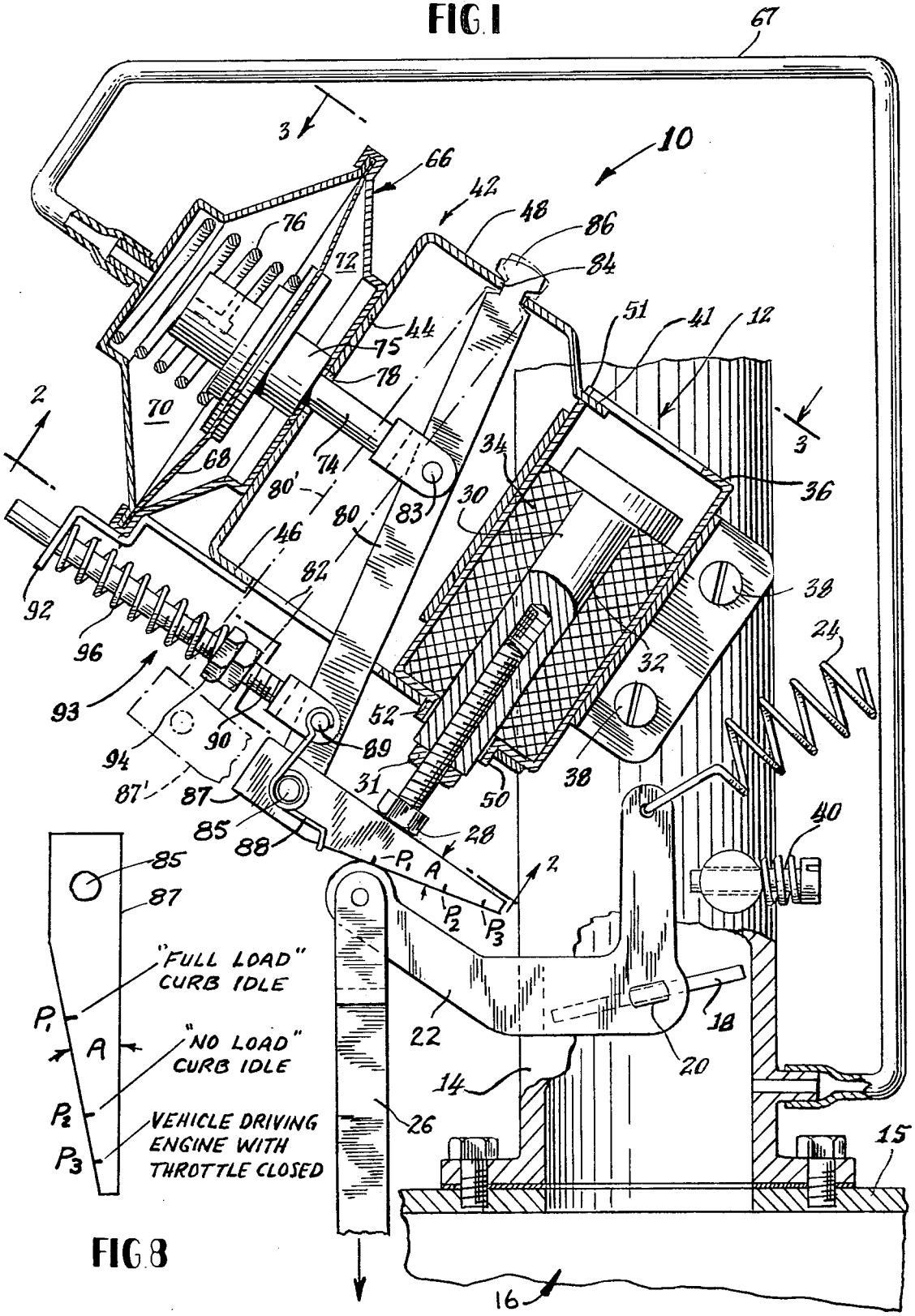
FIG. 1 is a side elevational view, shown partly in section, of the apparatus of the present invention. This apparatus is mounted on the antidieseling solenoid fixed to the carburetor of an internal combustion engine, which is intended to be typical of internal combustion engines used in automotive vehicles, such as automobiles, taxicabs, trucks, buses.
FIG. 8 shows the control cam with the points corresponding to said three conditions of throttle valve opening indicated and labelled.

Referring to FIG. 1, the apparatus of the present invention 10 for improving fuel consumption efficiency of a vehicular internal combustion engine is illustrated as being mounted on an antidieseling solenoid 12 which is in turn mounted on a carburetor housing 14 fixed to the engine intake manifold 15. The carburetor housing 14 feeds into the intake manifold 15 and includes means 18 for controlling the fuel and air flow, shown as a throttle valve, mounted in the carburetor for selectively, variable controlling the flow of fuel and air mixture from the carburetor into the induction passage 16.

As used herein, the term "induction passage" or "intake passage" is intended to refer to the passage 16 downstream from the throttle valve 18 including a portion of the carburetor and the intake manifold and any couplings between the carburetor and intake manifold.

This throttle valve 18 is secured on a rotatable shaft 20 which projects through the carburetor housing 14 and is connected to a throttle control arm 22. A spring 24 is connected to this arm 22 to urge it in a clockwise direction, as shown in FIG. 1, to thus urge the throttle valve 18 closed. A linkage 26 coupled to the accelerator pedal or other driver control (not shown), is employed to swing the arm 22 in a counterclockwise direction, as shown in FIG. 1, against the spring force to thus open and move the throttle valve 18 at the command of the driver.

The fuel and air flow control arm 22 is positioned by a primary idle stop 28, associated with the antidieseling solenoid 12, when the accelerator pedal is released, assuming the engine is warmed up. This primary idle stop 28 is formed by the head of an adjustable screw in the end of a plunger 30 which is reciprocally carried in the bore 32 of the solenoid 12. A winding 34 encircles this bore 32 and is connected to the automobile ignition circuit, as is conventional. This winding 34 is housed in a solenoid casing 36 which is fixed to the carburetor, for example, by machine screws 38.

When the ignition is switched on, the solenoid 12 is energized, moving the plunger 30 and the primary idle stop 28 out to the position shown in FIG. 1. This setting of the primary idle stop 28 positions the control arm 22 and the throttle valve to determine the primary or curb idle speed of the engine, after the engine has become warmed up, such that the automatic choke functions are no longer in play. This primary or curb idle speed is the speed at which the engine will run smoothly while powering all of the automobile's accessories when and if they are turned on.

When the ignition is switched off, the solenoid 12 is deenergized, permitting the plunger 30 and the primary idle stop 28 to retract. This retraction permits the throttle valve arm 22, urged by the spring 24, to rest against a secondary, fixed stop in the form of an adjustable screw 40, further closing the throttle valve 18 to assure quick stopping of the engine, without "dieseling" occurring.

This illustrative embodiment of the present invention 10 is intended to be operatively associated with the solenoid actuated primary idle stop 28 and the fuel and air flow control arm 22 to control the engine to make it idle at substantially constant speed, regardless of how many accessories are turned on. This apparatus 10 includes a U-shaped bracket 42 having a web portion 44 and two downwardly projecting legs 46 and 48.

The primary idle stop 28 is adjustable in position in the plunger 30, by screwing it in or out relative to the plunger. A locknut 31 is provided to hold the adjusted position. This primary idle stop can be adjusted in accordance with the number of power-operated accessories in the vehicle. The more accessories which are installed in the vehicle, the more that the stop screw 28 is extended by unscrewing from the plunger 30 to produce a more open throttle position, and vice versa.

Figure 2:
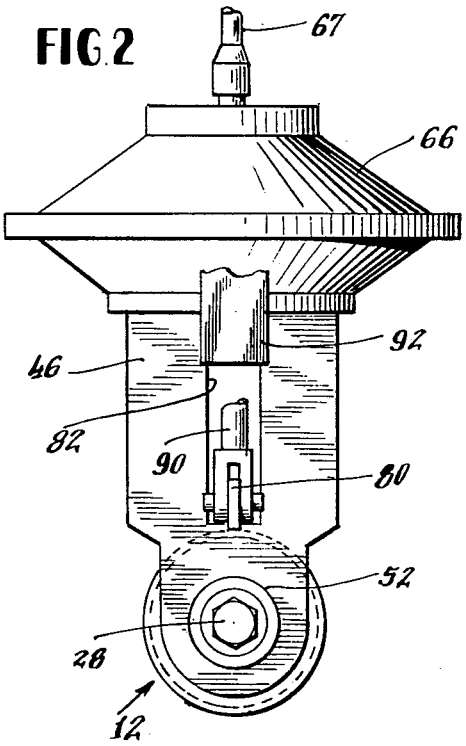
FIG. 2 is a partial front sectional view of this apparatus, as seen along the plane 2—2 in FIG. 1, showing the arrangement for engaging the front leg of the support bracket on the solenoid.
Figure 3:
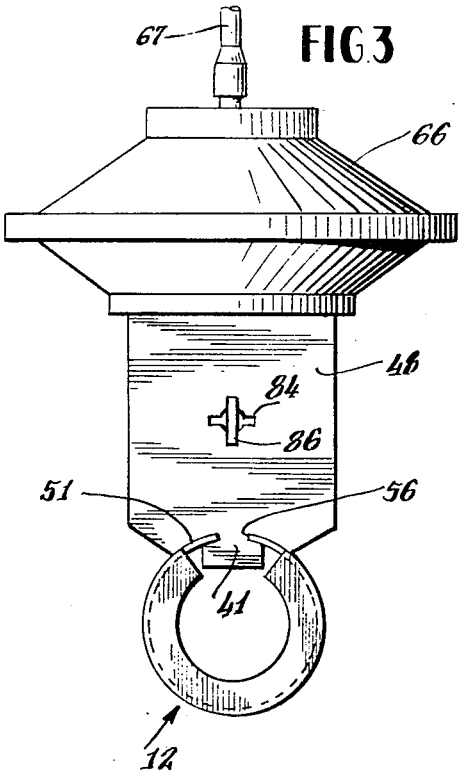
FIG. 3 is a partial rear elevational view of this apparatus as seen along the plane 3—3 in FIG. 1, showing a T-shaped support bracket tab engaged in the solenoid casing.

Frequently, the antidieseling solenoid 12 will be formed with a sleeve 50 which projects out of the main solenoid casing 36 and with an exposed rear wall 51. In this situation, a support bracket as shown in FIG. 1 may appropriately be used. The first (front) leg 46 of this bracket 42 is formed with a hole 52 which tightly fits over the projecting solenoid sleeve 50, as shown in FIGS. 1 and 2. The second (rear) leg 48 is formed with a T-shaped tab 41 at its end as shown in FIGS. 1 and 3. This tab 41 is adapted to be snapped into a notch 56 cut in the rear wall 51 (FIG. 3) of the solenoid casing at the end of the solenoid opposite the sleeve 50. Thus the support bracket may be installed on the antidieseling solenoid 12 by fitting the hole 52 over the solenoid sleeve 50 and then springing the rear leg 48 for snapping the T-shaped tab 41 into the notch 56.

Figure 4:
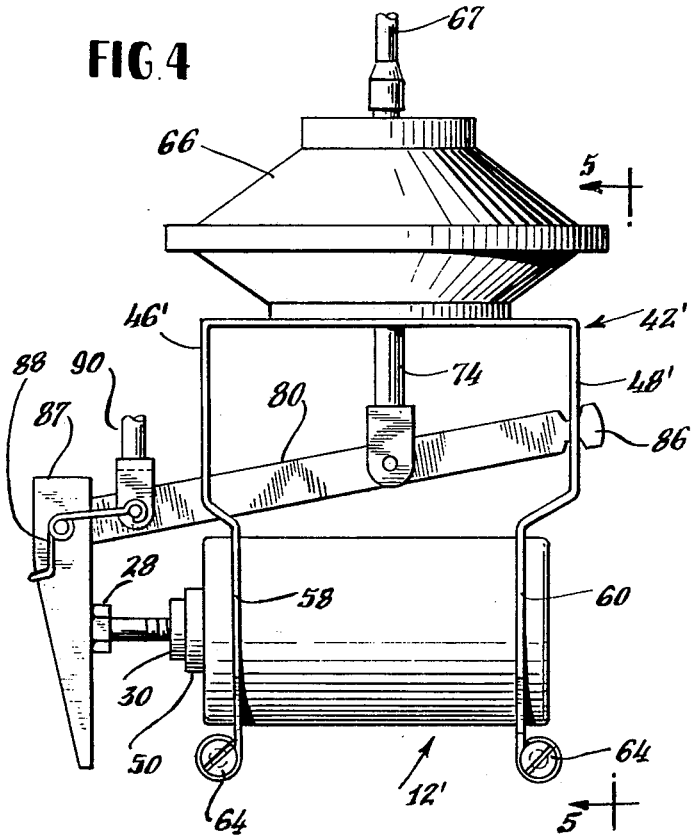
FIG. 4 is a side elevation view (similar to FIG. 1) of an alternative embodiment of the present invention showing the use of clamps for mounting the apparatus on the antidieseling solenoid.
Figure 5:
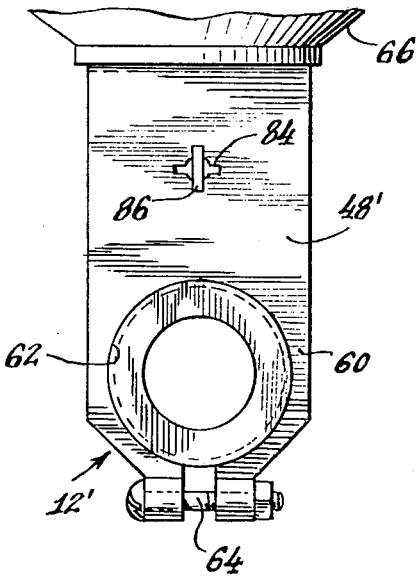
FIG. 5 is a partial rear elevational view of this embodiment as seen along the plane 5—5 in FIG. 4.

If, as shown in FIG. 4, the antidieseling solenoid 12' is not formed with a sleeve 50 and an exposed rear wall 51 but rather is of sealed, elongate shape, a support bracket 42' as shown in FIGS. 4 and 5 may appropriately be used. This bracket 42' includes two downwardly projecting legs 46' and 48', each of which is equipped with a clamp 58 and 60. Each clamp has a gripping hole 62, of suitable size to embrace the solenoid 12', which may be tightened about the solenoid body with a nut and bolt arrangement 64.

This bracket may be installed on the antidieseling solenoid merely by spreading the legs 46' and 48', engaging the clamps 58 and 60 over the solenoid's ends and tightening the clamps with the nut and bolt arrangements.

Thus, by virtue of these alternative support bracket arrangements, the apparatus of the present invention may be installed on existing engines with minimum effort requiring neither specialized tools nor skills.

Referring again to FIG. 1, the apparatus of the present invention further includes a vacuum actuator 66, also called a vacuum motor, mounted on top of the web portion 44 of the inverted U-shaped bracket 42 by welding or other suitable means. This vacuum actuator 66 is connected to the induction passage 16 downstream from the throttle valve by means of a conduit 67 and includes a diaphragm 68 which divides the interior of the actuator into an upper and lower chamber 70 and 72, respectively. An output shaft 74 is attached to the diaphragm and is urged toward its extended position by a spring 76. The output shaft 74 passes through a hole 78 in the web portion 44 of the support bracket 42, and this hole 78 exposes the lower chamber 72 to atmospheric pressure.

A linkage is provided coupling the actuator output shaft 74 to a cam 87. This linkage is shown as comprising a third class lever 80 mounted in the support bracket 42 above the antidieseling solenoid 12 so as to be pivoted at its rear end in the rear leg 48 of the bracket. The lever extends through a slot 82 in the front leg of the bracket 42. To facilitate assembly, the rear leg 48 may be provided with a horizontal keyway 84 which accepts a T-shaped key 86 on the pivoted end of the lever 80. Assembly is accomplished merely by inserting the key 86 into the keyway 84 and rotating the lever 80 by 90°, thus anchoring the lever in place, while still permitting it to swing.

The output shaft 74 is pivoted at 83 to the lever 80 intermediate the lever's fulcrum 84 and its free end. Therefore, the linear motion of the output shaft is multiplied at the lever's free end.

A cam 87 having an inclined surface is pivoted at 85 to the lever 80 and extends down from the free lever end. This cam is interposed between the control arm 22 and the primary solenoid idle stop 28 to provide varying degrees of separation between them and, therefore, to provide varying closed throttle valve positions. A spring 88 may be provided for urging the cam 87 against the primary solenoid idle stop 28. This spring 88 maintains the cam in continuous contact with the primary stop 28. Thus, the cooperative action of the cam and stop form a well defined reference position point against which the control arm can come to rest.

The cam 87, the lever 80, and the vacuum actuator 66 are arranged to provide a relatively more closed position of the throttle valve 18 when increased vacuum exists in the intake manifold, and a relatively more open throttle position when decreased vacuum exists in the intake manifold.

Adjustment and calibration means may be provided if it is desired to make the apparatus 10 applicable to a wide variety of engines. This adjustment and calibration means 93 includes a movable rod 90 pivotally connected at 89 near the lever's free end. This rod 90 extends through a fixed guideway 92 attached by spot welding or other means to the support bracket 42. A nut 94 is adjustably positioned on the rod 90 with a spring 96 mounted between this nut 94 and the guideway 92.

The purpose of the adjustment and calibration means 93 is to provide for convenient calibration to fit many different engines. As soon as the apparatus is installed, the engine is turned on and warmed up. The transmission is put in "drive", all of the power-consuming accessories are turned on, and the primary idle stop 28 and calibration means 93 are both adjusted in concert to position the actuator output shaft 74 and lever 80 in their extended position as shown at 80, to produce a smooth, low-speed curb idle at this "full load" condition, usually in the range from 550 to 600 rpm.

The fully extended position of the lever 80 may be determined by the end of the slot 82 or by bottoming of a shoulder 75 on the actuator output shaft 74, as shown.

Then, all of the accessories are turned off, and the automatic transmission is put in "neutral" at standstill to produce a "no load" curb idling condition. The characteristics of spring 96 and the slope angle A of cam 87 are selected to provide a range of movement of the cam 87 (see also FIG. 8) between the point $P_1$ at "full load" the point $P_2$ at "no load" idling conditions. Thus, the major portion of the available range of movement is utilized in going from "full load" to "no load" idling. With proper calibration and adjustment, it occurs that the idling speed at "full load" idle is approximately 50 rpm lower than that under "no load" conditions.

In other words, the idling speed is held substantially constant from "full load" to "no load", for the change is only about 9 percent, i.e. about 50 RPM out of about 550 RPM with the apparatus as shown. Normally, the range with a fixed throttle setting goes from about 560 RPM at "full load" idle to about 860 RPM at "no load" idle, a change of about 300 RPM out of about 560 RPM which amounts to 53 percent change in the prior art.

The remaining portion of the range of travel of the cam from point $P_2$ to point $P_3$ (see also FIG. 8) may be provided to allow the throttle to close further under conditions when the vehicle momentum is driving the engine such that the engine is absorbing power. This "vehicle driving engine" condition occurs during periods of closed throttle deceleration or downhill travel and creates pressures in induction passage 16 less than those existing at the several conditions of normal idling. Such further closing the throttle during non-idling closed-throttle decleration or downhill travel contributes additional fuel savings. The maximum fuel savings are obtained by adjusting the components to cause the throttle (when arm 22 is at the point $P_3$ on the cam 87) to be closed to the same position as when the control arm 22 is in contact with the secondary stop adjustment screw 40.

Although the apparatus as shown controls the engine idle speed to within approximately nine percent during curb idle at various load conditions, it is to be understood that the overall sensitivity may be increased by using a vacuum actuator 66 having a larger diaphragm area (or by using an actuator having a greater stroke per unit change in vacuum pressure or by providing greater multiplication by the lever 80 or by increasing the cam slope angle A). By such increased sensitivity in response, the percentage change in engine idle speed may be reduced below 9 percent. In most cases, as a practical matter, the fuel savings are so dramatic with the apparatus as shown, it may not be currently economical to utilize control apparatus of such increased sensitivity. However, the reader is to understand that this invention is capable of maintaining an even more uniform idle speed than the example being specifically discussed.

Reducing the stiffness of spring 96 decreases the rate of change of spring force and produces a greater stroke of the cam 87 between "no load" and "full load" conditions. Conversely, increasing the stiffness of spring 96 serves to decrease the stroke of cam 87. Springs 96 and 76 are effectively additive in operation. Accordingly, this adjustment and calibration means 93 enables the apparatus to be almost universal in application. It can be adjusted to fit smaller or larger engines, newer ones or older ones.

In other words, the apparatus of this invention can be conveniently installed and adjusted to provide substantially constant speed idling for a vast range in sizes and ages of vehicular engines.

The slope angle A of cam 87 is most necessarily a linear function of displacement. In other words, the slope of the inclined surface of cam 87 may vary from point to point along the slope. Although a longitudinally movable cam 87 is shown, it is to be understood that a rotatable cam may be used in some cases. It is preferred to use a longitudinally movable cam because it is easier to install. In either case, the cam always slopes in a positive direction as indicated by the angle A.

The reader is also to understand that the vacuum which is conducted through the conduit 67 from the induction passage to the vacuum motor 66 may be modulated to produce additional control sensitivity. For example, engine-speed responsive vacuum modulating means are shown in the prior art, e.g. engine-speed responsive valve means in conjunction with an adjustable atmospheric air bleed are shown in FIGS. 1 and 4 of U.S. Pat No. 3,577,962 — Ojala. Such an air bleed plug such an engine-speed responsive valve may be included in the conduit 67 to modulate the vacuum in chamber 70 so as to increase the sensitivity, if desired, to hold the engine speed more nearly constant.

Figure 9:
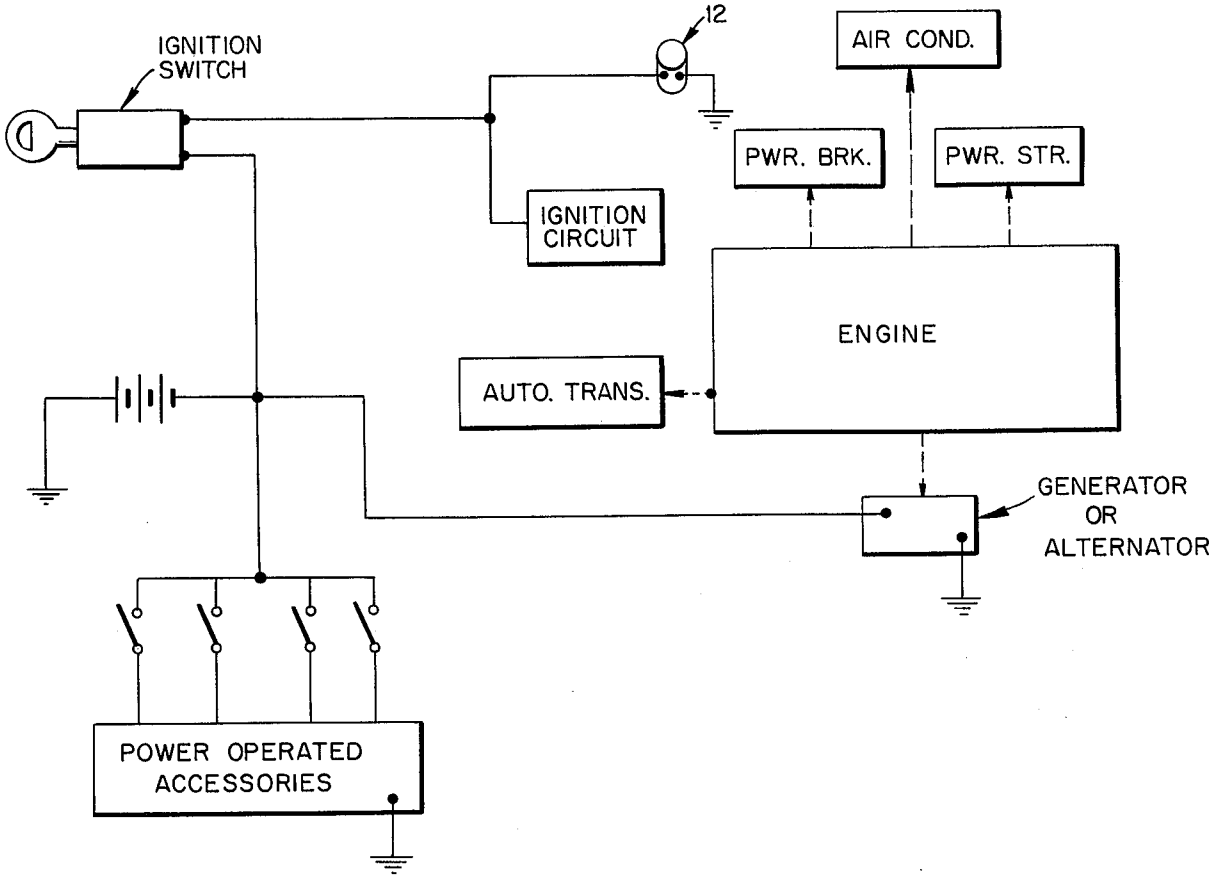
FIG. 9 shows the solenoid in combination with the engine, ignition, and power, operated elements.

Operation of the apparatus of the present invention may be explained by reference to FIG. 6, a graphical representation of the idle speed and "vehicle driving engine" operating characteristics of a 250 cubic inch displacement, 6 cylinder internal combustion engine of General Motors manufacture. Engine RPM is plotted along the horizontal axis with induction passage pressure being plotted along the vertical axis in inches of mercury absolute. Curve $T_1$ (normal practice) represents the speed-versus-manifold pressure relationship at a fixed throttle opening which would occur werenot the apparatus 10 installed. This curve $T_1$ for a fixed larger throttle opening corresponds to the throttle opening existing when cam 87 is positioned such that control arm 22 rests at point $P_1$ thereon (see also FIG. 9).

Curve $T_2$ shows the same relationship at a smaller fixed throttle opening which corresponds to that existing when cam 87 engages arm 22 at point $P_2$. At this throttle opening the engine idles at the desired value of the substantially constant idle speed with "no load" being imposed by powered accessories and/or automatic transmission.

Point G shows the engine RPM and induction passage pressure at the shut down throttle opening at "no load". This throttle opening G corresponds to that existing when arm 22 rests against shut down idle stop 40. In this illustrative example, opening G is also the condition where cam 87 engages arm 22 at point $P_3$. Curve R shows the induction passage pressure vs. engine RPM when the vehicle is driving the engine with the throttle at this shut down (minimum) position.

In the prior art the stop 40 is adjusted to give a point G (FIG. 6) at which engine shut down occurs without dieseling. Accordingly, the point G may vary in position. Since point G establishes the minimum throttle opening $T_3$, it determines the position of curve R.

When using the invention there are three factors which are taken into account in adjusting the minimum throttle opening $T_3$and hence the minimum curve R as established by the secondary stop 40:

1. The engine should shut down reliably without dieseling when the ignition is switched off and the primary stop 28 has been retracted out of play upon deenergization of the solenoid 12 so that the control arm 22 engages the secondary stop 40.

2. The more closed is throttle opening $T_3$, the more fuel will be saved by use of the invention under conditions when the vehicle is driving the engine with the operator's foot removed from the throttle pedal.

3. The engine should operate satisfactorily along curve R and during the transition from vehicle driving engine condition to idling conditions (Curve S). This transition occurs along curve U. Also, the engine should operate satisfactorily during transition from any other point on curve R to an engine driving vehicle condition.

The first two factors suggest that secondary stop 40 be adjusted as far as possible in a closed direction. The third factor suggest that the throttle cannot be unduly closed. Hence the curve R in some vehicles may lie somewhat above the position shown. For example, dot and dash curves 101 and 102 show alternative possible positions for curve R. The shaded region 103 indicated shows the range of possible positions for curve R. It is to be understood that if the curve R is in the location of 101 or 102, then the position of point G is correspondingly shifted.

Points on these curves are at the following engine load conditions.

| Point | Engine Load Condition |
|---|---|
| A | Automatic transmission in "neutral" and air conditioner off, at standstill. |
| B | Automatic transmission in "drive" and air conditioner off, at standstill. |
| C | Air conditioner on, automatic transmission in "neutral" at standstill. |
| D | Air condtioner on, automatic transmission in "drive" at standstill. |
| E | Automobile in motion on level surface at idle speed in third gear. |
| F | Operation of moving vehicle with vehicle driving engine and throttle closed. |

The connected curves S-U-R and the shaded area 103 are graphical plots showing the advantageous result of use of the invention providing variable throttle opening when the control arm 22 rests on control cam 87 in the closed position during idle and when the vehicle is driving the engine, thereby permitting the engine at each instant of time to operate at varying amounts of power, delivering less at idle when the engine is driving and absorbing more when the engine is being driven with the operator's foot removed from the throttle control pedal, under conditions of stop and go driving or during travel downhill.

The minimum range of satisfactory idle speed consistant with smooth engine operation is approximately 500 to 550 rpm. If forced to idle at speeds below this minimum range, the engine runs roughly or stalls. Therefore, in the prior art the fixed idle throttle setting (curve $T_1$) is usually employed when the vehicle is equipped with automatic transmission and air conditioning so that the engine will idle smoothly under all load conditions. Maximum load idle speed indicated at point $D_1$ is above the minimum satisfactory range.

When no load is placed on the engine, it idles at an inefficiently high speed $A_1$ consequently using relatively large amounts of fuel per unit time.

It is noted that the multiple accessory load at idle operating condition creates a self-worsening characteristic if there is only one idle throttle stop position as used in the prior art. The more accessories, the more open the position of the throttle stop; therefore, the higher the engine speed when only the automatic transmission is engaged in "Drive" with the vehicle at standstill. Thus, more wasted power which must be absorbed by the automatic transmission at standstill because the energy absorbed by the stalled automatic transmission increases with engine speed.

Point E is noted on the several curves to indicate that more load is placed on the engine in driving the automatic transmission at the standstill condition, than is placed on the engine in moving the vehicle on level ground at the speed achieved at the respective throttle openings $T_1$ or $T_2$ or under the controlled operating conditions along curve S.

It is among the advantages of the present invention to cause the engine to idle at substantially constant speed (along curve S) to eliminate this inefficient fuel consumption resulting from the unnecessarily high, unloaded engine idle speed and to decrease fuel consumption when the engine is being driven by the vehicle (along curve R).

As can be seen from curves $T_1$, $T_2$ and $T_3$, at any given throttle setting the absolute pressure in the induction passage is inversely related to engine speed and directly related to engine load. That is, as the engine load increases and the engine speed consequently decreases, the absolute pressure in the induction passage increases.

Figure 6:
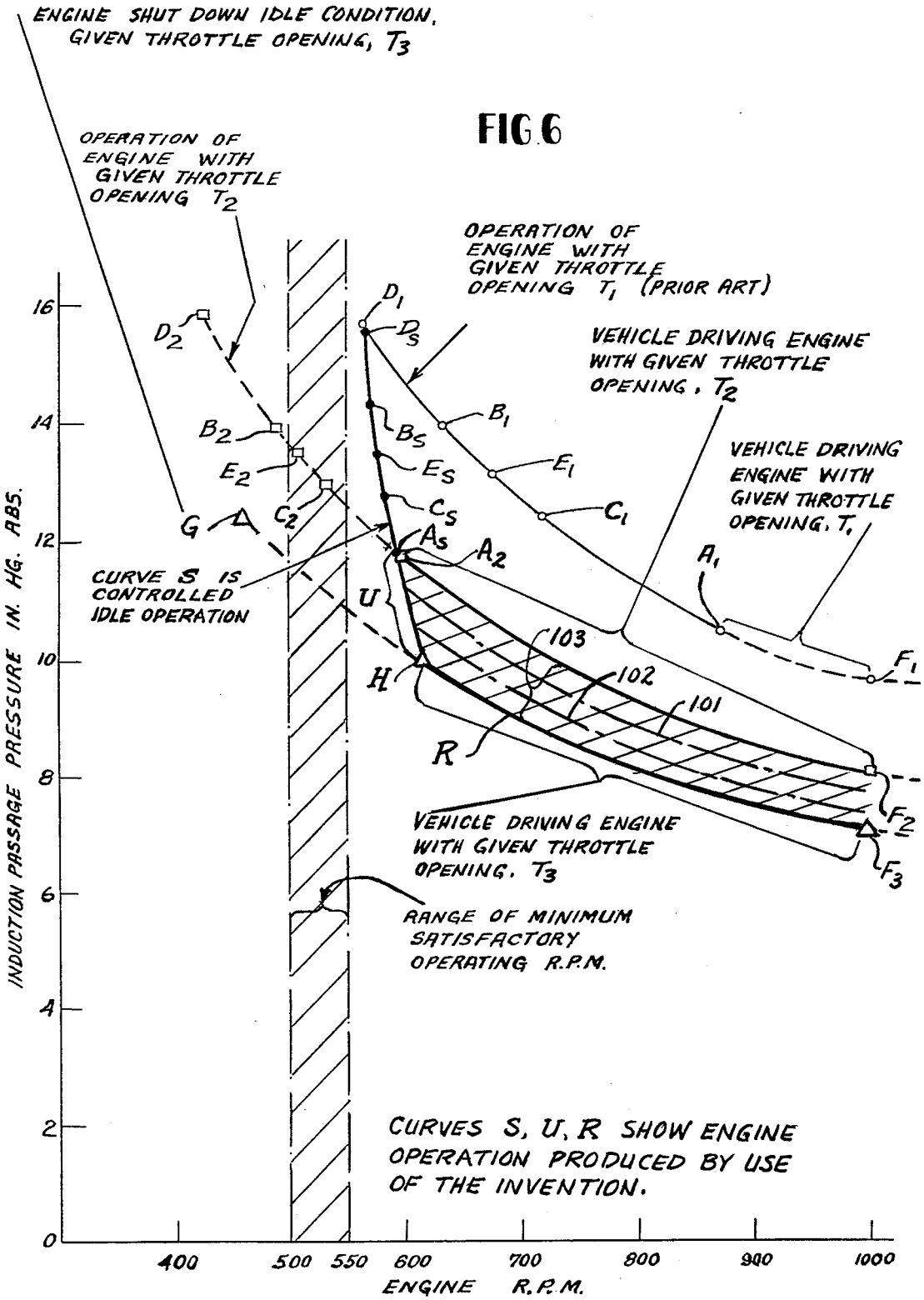
FIG. 6 is a graphical representation of the speed of the internal combustion engine relative to the pressure in its intake manifold at three conditions of throttle valve opening and with one choice of range of variable throttle opening, with the present inventive apparatus installed.
Figure 7:
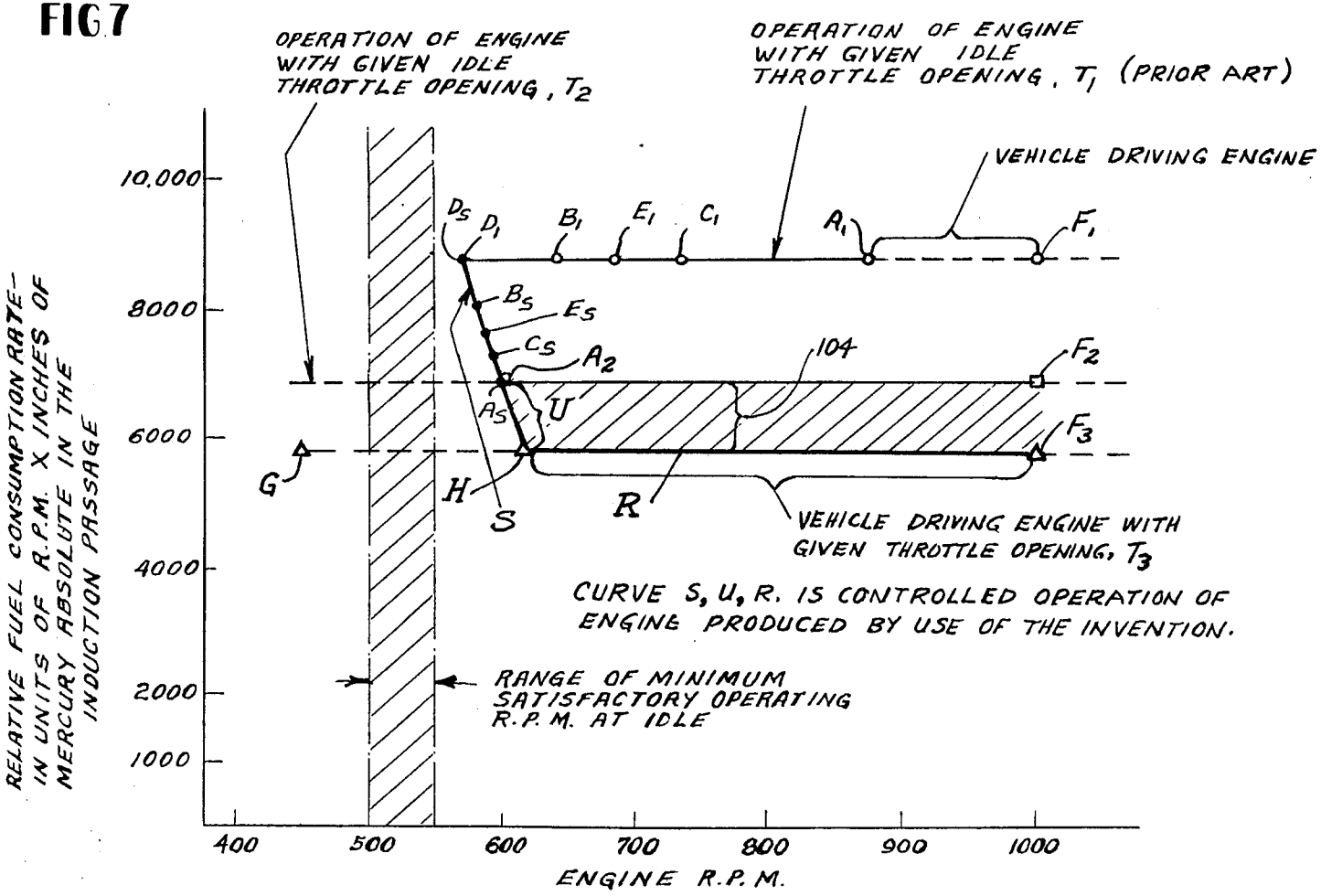
FIG. 7 is a graphical representation of fuel consumption under various operating conditions, corresponding to FIG. 6.

A revealing comparison of engine fuel consumption characteristics is shown in FIG. 7. The various points along curve S in FIG. 7, namely points $D_s$, $B_s$, $E_sC_s$ and $A_s$ are derived from FIG. 6 on the basis that the relative fuel consumption rate for a given internal combustion engine at idle conditions for each different throttle opening is approximately directly proportional to the product of the engine RPM and the absolute pressure of the air-fuel mixture in the induction passage, assuming that air-fuel mixture ratio is relatively constant at engine idle conditions.

The reason why the fuel consumption rate of an internal combustion engine is approximately directly proportional to engine RPM times the absolute pressure in the induction passage is that such an engine is in effect a pump. The RPM is a measure of the number of pumping strokes per minute and therefore is proportional to the total volume of fuel-air mixture being pumped per unit time. In addition, the density of the fuel-air mixture in the induction passage is proportional to the absolute pressure in this passage. Thus, by multiplying the density times volume per unit time gives a measure of the fuel consumption rate. This statement applies over the limited rate of engine speed under discussion, because the rate of fuel-air flow in the induction passage is relatively low so that volumetric pumping action of the engine over this range is relatively constant. Further, the temperature is relatively constant over this limited range of enging speed so that temperature changes have minimal effect on the density. This fuel consumption rate is plotted along the vertical axis in units of RPM *x* inches of mercury absolute pressure. The engine RPM is plotted along the horizontal axis.

In FIG. 7, curve $T_1$ represents the fuel consumption rate versus RPM at the given larger primary idle stop throttle opening for this same engine. Curves $T_2$ and $T_3$ show the same relationships as described for these curves in FIG. 6. The coded points A to F represent the same load conditions as in FIG. 6.

It can be qualitatively reasoned that at closed throttle idle or vehicle-driving-engine operation where the ratio of the induction passage pressure to the pressure upstream of the fuel and air flow control means 18 is less than the "critical pressure ratio" of 0.533, then the flow past the throttle means 18 is at the aconstic velocity, i.e. at the maximum attainable. Therefore, in the ranges of operation being discussed, fuel and air flow rate (and hence fuel consumption rate) varies with the size of the throttle opening.

Consequently, for the induction passage pressures shown, the relative fuel consumption rate of each of the given throttle openings $T_1$, $T_2$, or $T_3$ will be constant as the pressure is decreased as a result of the vehicle driving the engine. Hence, the curves $D_1$–$F_1$, $A_2$–$F_2$, and H–$F_3$ are horizontal lines.

It is noted that the engine operating with given throttle opening $T_2$ will use fuel at a time rate approximately 23% less than the same engine operating at given throttle opening $T_1$. At the throttle opening $T_3$, the reduction in fuel use is greater. The engine can operate satifactorily at throttle opening $T_2$ at no load idle $A_2$. Any increase in load by engaging the automatic transmission and/or accessories causes the engine speed to drop to unsatisfactorily low levels, as shown at $C_2$, $E_2$, $B_2$ or $D_2$ in FIG. 6.

With use of the inventive apparatus however, as shown in FIG. 7, the engine fuel consumption characteristic at idle is defined by curve S. At any idle load condition at less than "full power" idle, the rate of fuel consumption is reduced proportionally with the load. This marked saving in fuel is seen by comparing the fuel consumption rate along the curve S (FIG. 7) from $D_s$ - $B_2$ - $E_2$ - $C_s$ - $A_s$ to the consumption along curve $T_1$ from $D_1$ - $B_1$ - $E_1$ - $C_1$ - $A_1$, as occurs in the prior art.

In both FIGS. 6 and 7, curves S is that part of the controlled engine operation produced by use of the invention where power is flowing from the engine. Curve R is controlled engine operation where power is flowing from the vehicle to the engine. Curve U is the transition between the two above conditions, with point H being at the intersection of curves U and R. Points the right of $A_s$, in the shaded areas 103 (FIG. 6) or 104 (FIG. 7), exist when the vehicle is moving.

During vehicle-driving-engine operation, fuel is used according to the low rate characteristic along curve R from H to $F_3$ or along curve U from H to $A_s$, rather than at the higher rate occurring along curve $T_1$ from $A_1$ to $F_1$.

Referring to FIG. 1, it can be seen that an increase in induction passage pressure due to higher engine load will act upon the diaphragm 68 in the vacuum actuator 66 to extend the output shaft 74, in turn moving the cam 87 downward. The cam then separates the throttle valve arm 22 and the primary solenoid idle stop 28 by a relatively larger distance to cause the throttle valve 18 to assume a more open position to carry the increase in load.

Similarly, the decrease in such pressure due to lower engine load will act upon the vacuum actuator diaphragm 68 to retract the output shaft 74, in turn moving the cam 87 upward. The cam then separates the throttle valve arm 22 and the primary solenoid idle stop 28 by a relatively smaller distance to cause the throttle valve to assume a more closed position to offset the decrease in engine load.

Under "vehicle-driving-engine" operation, low absolute pressure exists in the induction passage because the momentum of the automobile drives the engine through the drive gear train, i.e. power flows through the drive gear train to the engine driving it at a speed faster than normal idle. This results in engine compression braking of the automobile. As explained above, this condition causes the cam to move upward (from point $P_2$ toward $P_3$) allowing the throttle valve to close further. Consequently, when the present invention is utilized, the engine compression braking effect is enhanced. Because the more closed throttle presents a greater restriction to the flow of fuel-air mixture to the induction passage, the absolute pressure in this passage is decreased. In addition, since the engine is being driven by the motion of the vehicle, the input of energy to the engine due to vehicle momentum is available to drive the engine's accessories. Accordingly, the fuel consumption rate is reduced below the curve $D_1$ -$F_1$ for the opening $T_1$.

It is to be understood that this reduction in fuel consumption continues to occur when the vehicle is driving the engine at RPM's higher than 1,000, as indicated by the dashed extensions at the right ends of the several curves in FIGS. 6 and 7. The graphical plots end near 1,000 RPM for convenience of illustration at large scale on one sheet.

By selecting a proper shape for the cam, and by properly selecting and adjusting the spring 96, the engine may be made to idle at a substantially constant speed under all load conditions, as represented by curve S, resulting in better fuel consumption efficiency and producing better "engine" braking during closed throttle deceleration of the vehicle or when braking by the "engine" going downhill, as represented by curves U and R.

The apparatus of the present invention then improves fuel consumption efficiency of an internal combustion engine during idling and during stop and go driving conditions and when the vehicle's momentum is driving the engine (including downhill driving).

It has been found in actual practice on said 250 cubic inch displacement engine that overall consumption in stop and go driving can be reduced by 6% to 13% by employing this invention, depending on driving habits and upon the driving conditions encountered.

The slight amount of friction occurring between the arm 22 and the cam 87, and between the am 87 and the stop 28 has as beneficial effect in providing damping to the control action. Thus, the control does not "hunt" or oscillate about the balance point. Rather, it produces a stable control action which is quick and accurate to maintain a substantially constant engine idle speed in spite of abrupt changes in engine load conditions. Additional damping can be achieved by installing a restrictive orifice in conduit 67, if desired.

Although specific embodiments of the invention have been disclosed in detail above, it is to be understood that this is for purposes of illustration. This disclosure is not to be construed as limiting the scope of the invention, since the described structure may be changed in particular details by those skilled in the art in order to adapt this apparatus to particular applications, without departing from the scope of the following claims. For instance, the fuel and air flow control means may be other than the illustrated throttle valve. In such case where a fuel and air flow control arm serves the function of a throttle arm, apparatus embodying the invention is applicable.

Although the illustrative embodiment of the invention holds the engine speed constant along curve S within a range of 9 percent, it is to be understood that significant fuel savings are obtained even when the engine speed along curve S varies over a range of plus or minus 10 percent, i.e., a total range of 20%.

I claim:

1. Apparatus for use in a vehicular engine drive system including an automatic transmission wherein air-fuel flow control means associated with an induction passage leading to the engine are provided for controlling engine power and speed with a movable control member for operating said air-fuel flow control means, said apparatus comprising a solenoid for allowing said control member to move to an engine shut down position; positioning means for moving said control member for providing varying air-fuel flow; pressure-responsive means connected to said induction passage for controlling said positioning means during idling when the operator's foot is removed from the accelerator pedal for moving said positioning means to move said control member to variably increase air-fuel flow at idling when the pressure in said induction passage increases due to the tendency for the engine to slow down when one or more power-operated accessories are put in use and for moving said positioning means to move said control member to variably decrease air-fuel flow at idling when the pressure in said induction passage decreases due to the tendency for the engine to speed up when use of one or more power-operated accessories is discontinued; and said solenoid moving said positioning means for holding said positioning means in an operating position during engine operation and for moving said positioning means and said control member to an engine shut down position; said pressure-responsive means also controlling said positioning means during deceleration and downhill travel when the operator's foot is removed from the accelerator pedal for moving said positioning means to move said control member to decrease further the air-fuel flow when the vehicle momentum is driving the engine; whereby the position of said control member results from the sum of the control action of said pressure-responsive means plus the control action of said solenoid, thereby reducing fuel consumption by automatically controlling engine speed during idling and air-fuel flow during deceleration and downhill travel when the operator's foot is removed from the accelerator pedal and vehicle momentum is driving the engine.

2. Apparatus as claimed in claim 1, in which said apparatus automatically maintains the engine speed constant within a plus or minus 10 percent range regardless of whether all or some or none of the power-operated accessories are in use at vehicle standstill, including engagement or disengagement of the automatic transmission.

3. Apparatus as claimed in claim 1 in which said positioning means is movable back-and-forth in a first direction under control of said pressure-responsive means and is movable in a second direction under control of said solenoid.

4. Apparatus as claimed in claim 1, in which said pressure-responsive means is connected by a mechanical linkage to said positioning means, and adjustable calibration means are connected to said mechanical linkage.

5. Apparatus as claimed in claim 1 in which said pressure-responsive means is mounted on a support which is mounted on the solenoid.

6. Idle speed engine control apparatus for improving fuel consumption efficiency of a vehicular internal combustion engine having an automatic transmission, power-operated accessories, an ignition circuit, an induction passage for conducting fuel and air to the engine, fuel and air flow control means equipped with an operating arm for variably, selectively controlling the feed of fuel and air to said induction passage, an "antidieseling" operating arm positioning solenoid having a primary idle stop for positioning the operating arm for idle conditions when the ignition circuit is switched on and for positioning the operating arm against a shut down stop when the ignition circuit is switched off, said idle speed control apparatus comprising:

a vacuum actuator connected to be responsive to pressure in said induction passage and having an output shaft;

a cam interposed between said operating arm and the antidieseling solenoid primary idle stop; and linkage means connecting said vacuum actuator output shaft to said cam for moving said cam in response to changes in the pressure in the induction passage, said vacuum actuator, said linkage means, and said cam cooperating to respond to the pressure in said induction passage for causing the fuel and air flow control means to move toward a more open position upon increase in the pressure in said induction passage, and vice versa, to control the engine at idle when the operator's foot is removed from the accelerator pedal to hold engine speed within a plus or minus 10 percent range under all engine load conditions during idling.

7. The idle speed control apparatus for improving fuel consumption efficiency of a vehicular internal combustion engine as claimed in claim 6 in which:

support means is provided for mounting said vacuum actuator, and said support means includes mounting means adapted to be fitted onto the antidieseling operating arm positioning solenoid.

8. The idle speed control apparatus for improving fuel comsumption efficiency of a vehicular internal combustion engine as claimed in claim 7 in which:

said supporrt means is a U-shaped bracket having a back portion and a pair of legs extending therefrom, said vacuum actuator being mounted on the back portion of said U-shaped bracket, and said mounting means being associated with both of said legs adapted for mounting on opposite ends of said solenoid.

9. The idle speed control apparatus for improving fuel consumption efficiency of a vehicular internal combustion engine as claimed in claim 8 in which the antidieseling solenoid is housed in a casing having an exposed notch at one end thereof and a projecting sleeve at the opposite end thereof and wherein said mounting means comprises:

said first bracket leg having a hole therein adapted to be fitted over the sleeve at said one end of the antidieseling solenoid casing; and said second bracket leg having a T-shaped tab adapted to snap into and engage said notch in the antidieseling solenoid casing.

10. Idle speed engine control apparatus for improving fuel consumption efficiency of a vehicular internal combustion engine having an induction passage for conducting fuel and air to the engine, fuel and air flow control means equipped with an operating arm for controlling the flow of fuel and air through said induction passage to the engine and an "antidieseling" operating arm positioning solenoid having a movable primary idle stop for positioning said operating arm for idle conditions when the ignition circuit is switched on and for retracting said primary stop for allowing said operating arm to rest against a shut down stop when the ignition circuit is switched off, said idle speed control apparatus comprising a vacuum actuator connected to be responsive to the pressure in said induction passage and having an output shaft, support means for mounting said vacuum actuator near said operating arm of the fuel and air flow control means, a generally wedge-shaped cam positioned between said primary idle stop and said operating arm, a third-class lever pivoted at a first end in said support means forming a fulcrum for said lever, the movable outer end of said lever being pivotally connected to said wedge-shaped cam for allowing said cam to follow the retraction of said primary stop during engine shut down, and said output shaft of said vacuum actuator being pivotally coupled to said lever intermediate said fulcrum pivot and the outer end of said lever for multiplying the movement of said wedge-shaped cam relative to the movement of the output shaft of said vacuum actuator for moving said cam in response to changes in the pressure in said induction passage to move the operating arm for increasing fuel and air flow upon increase in the pressure in said induction passage, and vice versa to control the engine speed under all engine load conditions during idling.

11. Idle speed engine control apparatus as claimed in claim 10, in which:

calibration means are operatively associated with the movable outer end of said lever, said calibration means including a guide rod pivotally connected near the outer end of said lever, guide means on said support means for guiding said guide rod, a coil spring around said guide rod, and adjustable spring engaging means on said guide rod for adjusting the effective length of said spring, thereby to adjust the spring force acting on said lever.

12. Idle speed engine control apparatus as claimed in claim 10, in which:

said wedge-shaped cam is pivotally connected to the movable outer end of said lever by a pivot connection located near the wider end of said cam, and spring means near said pivot connection for urging said cam to swing into engagement with said primary idle stop.

13. In a vehicular internal combustion engine system wherein the engine is controlled by a throttle associated with an induction passage, such throttle having an operation arm for controlling the flow of fuel and air through the induction passage to the engine and wherein the vehicle is equipped with an automatic transmission and power-operated accessories, and a solenoid-actuated stop for positioning the throttle operating arm, idle speed control apparatus for the engine comprising:

a movable cam member positioned between said solenoid-actuated stop and said throttle operating arm, said cam member having an inclined surface which continuously slopes in one direction throughout its entire operating range, a vacuum actuator having a chamber connected to the induction passage for moving said cam in response to changes in pressure in said induction passage, and a linkage coupling said vacuum actuator to said cam for moving said cam.

14. In a vehiclar internal combustion engine system wherein the vehicle is equipped with an automatic transmission and the engine is controlled by fuel and air flow control means having an operating arm, said fuel and air flow control means controlling the fuel and air being supplied through an induction passage to the engine, and wherein the operating air normally rests against an adjustable idle stop during idling of the engine with the operator's foot removed from the accelerator pedal, fuel conserving apparatus providing a variable opening of the fuel and air flow control means under conditions of varying engine loads at such idling created by operation of varying numbers of powered accessories on the vehicle including engagement of the automatic transmission, said apparatus comprising a cam interposed between said operating arm and said adjustable idle stop, means for moving said cam to cause the fuel and air flow control means to become more open when an increase in engine load occurs at such idling due to operation of an increased number of powered accessories the vice versa, and said cam being effectively continuously sloped in one direction throughout its entire operating length with respect to said adjustable idle stop for moving the operating arm toward a more closed position of said fuel and air flow control means when the vehicle is decelerating or travelling downhill with the automatic transmission engaged and the operator's foot removed from the accelerator pedal so that the momentum of the vehicle is driving the engine at a speed greater than that which corresponds to the desired engine idle speed at such idling when no powered accessories are operating.

15. In a vehicular internal combustion engine, fuel conserving apparatus as claimed in claim 14, in which:

said cam is a wedge-shaped cam which continuously tapers in one direction.

16. In a vehicular internal combustion engine, fuel conserving apparatus as claimed in claim 14, in which:

said more closed position which is achieved during deceleration and downhill travel with the operator's foot removed from the accelerator pedal is the same position which the operating arm also occupies during engine shut-down.

17. Apparatus for use in a vehicular engine drive system including an automatic transmission wherein air-fuel flow control means associated with an induction passage leading to the einge are provided for controlling engine power and speed with a removable control member for operating said air-fuel flow control means, said apparatus comprising a solenoid for allowing said control member to move to an engine shut down position; a cam which continuously slopes in one direction throughout its operating range for moving said control member for providing varying air-fuel flow; pressure-responsive means connected to said induction passage for controlling said cam during idling when the operator's foot is removed from the accelerator pedal for moving said cam to move said control member to variably increase air-fuel flow at idling when the pressure in said induction passage increases due to the tendency for the engine to slow down when one or more power-operated accessories are put in use and for moving said cam to move said control member to variably decrease air-fuel flow at idling when the pressure in said induction passage decreases due to the tendency for the engine to speed up when use of one or more power-operated accessories is discontinued; and said solenoid moving said cam for holding said cam in an operating position during engine operation and for moving said cam and said control member to an engine shut down position; said pressure-responsive means also controlling said cam during deceleration and downhill travel when the operator's foot is removed from the accelerator pedal for moving said cam to move said control member to decrease further the air-fuel flow when the vehicle momentum is driving the engine; whereby the position of said control member results from the sum of the control action of said pressure-responsive means plus the control action of said solenoid, thereby reducing fuel consumption by automatically controlling engine speed during idling and air-fuel flow during deceleration and downhill travel when the operator's foot is removed from the accelerator pedal and vehicle momentum is driving the engine.

18. Apparatus as claimed in claim 17, in which said cam slopes in one direction throughout its entire operating range and slopes sufficiently far to decrease the air-fuel rate to a shut-down value for the engine when the engine is being driven by the momentum of the vehicle during vehicle deceleration or downhill travel with the automatic transmission engaged and the operator's foot removed from the accelerator pedal.

19. Apparatus for use in a vehicular engine drive system including an automatic transmission wherein air-fuel flow control means associated with an induction passage leading to the engine are provided for controlling engine power and speed with a movable control member for operating said air-fuel flow control means, said apparatus comprising a solenoid for allowing said control member to move to an engine shut down position; a first stop moved by said solenoid, a cam interposed between said control member and said first stop for moving said control member for providing varying air-fuel flow; pressure-responsive means connected to said induction passage for controlling said cam during idling when the operator's foot is removed from the accelerator pedal for moving said cam to move said control member to variably increase air-fuel flow at idling when the pressure in said induction passage increases due to the tendency for the engine to slow down when one or more power-operated accessories are put in use and for moving said cam to move said control member to variably decrease air-fuel flow at idling when the pressure in said induction passage decreases due to the tendency for the engine to speed up when use of one or more power-operated accessories or discontinued; and said solenoid moving said cam for holding said cam in an operating position during engine operation and for moving said cam and said control member to an engine shut down position; said pressure-responsive means also controlling said cam during deceleration and downhill travel when the operator's foot is removed from the accelerator pedal for moving said cam to move said control member to decrease further the air-fuel flow when the vehicle momentum is driving the engine; whereby the position of said control member results from the sum of the control action of said pressure-responsive means plus the control action of said solenoid, thereby reducing fuel consumption by automatically controlling engine speed during idling and air-fuel flow during deceleration and downhill travel when the operator's foot is removed from the accelerator pedal and vehicle momentum is driving the engine.

20. Apparatus for use in a vehicular engine drive system including an automatic transmission wherein air-fuel flow control means associated with an induction passage leading to the engine are provided for controlling engine power and speed with a movable control member for operating said air-fuel flow control means, said apparatus comprising a solenoid for allowing said control member to move to an engine shut down position; pressure-responsive means connected to said induction passage; a longitudinally tapered cam for moving said control member for providing varying air-fuel flow; said longitudinally tapered cam being movable longitudinally back and forth by said pressure-responsive means for controlling said tapered cam during idling when the operator's foot is removed from the accelerator pedal for moving said tapered cam to move said control member to variably increase air-fuel flow at idling when the pressure in said induction passage increases due to the tendency for the engine to slow down when one or more power-operated accessories are put in use and for moving said tapered cam to move said control member to variably decrease air-fuel flow at idling when the pressure in said induction passage decreases due to the tendency for the engine to speed up when use of one or more power-operated accessories is discontinued; and said solenoid also controlling said tapered cam by moving said tapered cam laterally for holding said tapered cam in an operating position during engine operation and for moving said tapered cam and said control member to an engine shut down position; said pressure-responsive means moving said tapered cam during deceleration and downhill travel when the operator's foot is removed from the accelerator pedal for moving said tapered cam to move said control member to decrease further the air-fuel flow when the vehicle momentum is driving the engine; whereby the position of said control member results from the sum of the control action of said pressure-responsive means plus the control action of said solenoid, thereby reducing fuel consumption by automatically controlling engine speed during idling and air-fuel flow during deceleration and downhill travel when the operator's foot is removed from the accelerator pedal and vehicle momentum is driving the engine.

21. Apparatus for use in a vehicular engine drive system including an automatic transmission wherein air-fuel flow control means associated with an induction passage leading to the engine are provided for controlling engine power and speed with a movable control member for operating said air-fuel flow control means, said apparatus comprising a solenoid for allowing said control member to move to an engine shut down position; positioning means for moving said control member for providing varying air-fuel flow; pressure-responsive means connected to said induction passage; said pressure-responsive means being connected by a mechanical linkage to said positioning means, and said mechanical linkage including a third-class lever for multiplying the motion of said positioning means relative to the motion of said pressure-responsive means for controlling said positioning means during idling when the operator's foot is removed from the accelerator pedal for moving said positioning means with multiplied motion to move said control member to variably increase air-fuel flow at idling when the pressure in said induction passage increases due to the tendency for the engine to slow down when one or more power-operated accessories are put in use and for moving said positioning means with multiplied motion to move said control member to variably decrease air-fuel flow at idling when the pressure in said induction passage decreases due to the tendency for the engine to speed up when use of one or more power-operated accessories is discontinued; and said solenoid moving said positioning means for holding said positioning means in an operating position during engine operation and for moving said positioning means and said control member to an engine shut down position; said pressure-responsive means also controlling said positioning means during deceleration and downhill travel when the operator's foot is removed from the accelerator pedal for moving said positioning means to move said control member to decrease further the air-fuel flow when the vehicle momentum is driving the engine; whereby the position of said control member results from the sum of the control action of said pressure-responsive means plus the control action of said solenoid, thereby reducing fuel consumption by automatically controlling engine speed during idling and air-fuel flow during deceleration and downhill travel when the operator's foot is removed from the accelerator pedal and vehicle momentum is driving the engine.

22. Apparatus for use in a vehicular engine drive system including an automatic transmission wherein air-fuel flow control means associated with an induction passage leading to the engine are provided for controlling engine power and speed with a movable control member for operating said air-fuel flow control means, said apparatus comprising a solenoid for allowing said control member to move to an engine shut down position; positioning means for moving said control member for providing varying air-fuel flow; pressure-responsive means connected to said induction passage for controlling said positioning means during idling when the operator's foot is removed from the accelerator pedal for moving said positioning means to move said control member to variably increase air-fuel flow at idling when the pressure in said induction passage increases due to the tendency for the engine to slow down when one or more power-operated accessories are put in use and for moving said positioning means to move said control member to variably decrease air-fuel flow at idling when the pressure in said induction passage decreases due to the tendency for the engine to speed up when use of one or more power-operated accessories is discontinued; and said solenoid moving said positioning means for holding said positioning means in an operating position during engine operation and for moving said positioning means and said control member to an engine shut down position; said pressure-responsive means also controlling said positioning means during deceleration and downhill travel when the operator's foot is removed from the accelerator pedal for moving said positioning means to move said control member to decrease further the air-fuel flow when the vehicle momentum is driving the engine; said positioning means being pivotally mounted by a pivot and means being provided for keeping said positioning means in its operating position; said positioning means being movable back-and-forth in a first direction under control of said pressure-responsive means and being movable in a second direction under control of said solenoid; whereby the position of said control member results from the sum of the control action of said pressure-responsive means plus the control action of said solenoid, thereby reducing fuel consumption by automatically controlling engine speed during idling and air-fuel flow during deceleration and downhill travel when the operator's foot is removed from the accelerator pedal and vehicle momentum is driving the engine.

23. Apparatus for use in a vehicular engine drive system including an automatic transmission wherein air-fuel flow control means associated with an induction passage leading to the engine are provided for controlling engine power and speed with a movable control member for operating said air-fuel flow control means, said apparatus comprising a solenoid for allowing said control member to move to an engine shut down position; positioning means for moving said control member for providing varying air-fuel flow; pressure-responsive means mounted on a support which is mounted on said solenoid, said support being a U-shaped bracket having two legs with attachment means for attaching said legs to the solenoid; said pressure-responsive means being connected to said induction passage for controlling and positioning means during idling when the operator's foot is removed from the accelerator pedal for moving said positioning means to move said control member to variably increase air-fuel flow at idling when the pressure in said induction passage increases due to the tendency for the engine to slow down when one or more power-operated accessories are put in use and for moving said positioning means to move said control member to variably decrease air-fuel flow at idling when the pressure in said induction passage decreases due to the tendency for the engine to speed up when use of one or more power-operated accessories is discontinued; and said solenoid moving said positioning means for holding said positioning means in an operating position during engine operation and for moving said positioning means to said control member to an engine shut down position; said pressure-responsive means also controling said positioning means during deceleration and downhill travel when the operator's foot is removed from the accelerator pedal for moving said positioning means to move said control member to decrease further the air-fuel flow when the vehicle momentum is driving the engine; whereby the position of said control member results from the sum of the control action of said pressure-responsive means plus the control action of said solenoid, thereby inducing fuel consumption by automatically controlling engine speed during idling and air-fuel flow during deceleration and downhill travel when the operator's foot is removed from the accelerator pedal and vehicle momentum is driving the engine.

* * * * *